United States Patent [19]

Chiou

[11] Patent Number: 4,870,754

[45] Date of Patent: Oct. 3, 1989

[54] CASSETTE KITCHEN UTENSILS SET

[76] Inventor: Jeng-Jong Chiou, 3F-1, No. 337, Sec. 4, Hsin Yi Rd., Taipei, Taiwan

[21] Appl. No.: 169,061

[22] Filed: Mar. 17, 1988

[51] Int. Cl.[4] ..... B26B 1/00; B65D 1/34

[52] U.S. Cl. ..... 30/123; 206/374; 206/553

[58] Field of Search ..... 30/296 R, 296 A, 123, 30/142, 147–150; 206/214, 216, 576, 553, 374; 248/37.3

[56] References Cited

U.S. PATENT DOCUMENTS 2,487,174 11/1949 Petre ..... 206/374 X 2,710,094 6/1955 Rau ..... 206/553

*Primary Examiner*—Douglas D. Watts

*Attorney, Agent, or Firm*—Lowe, Price, LeBlanc, Becker & Shur

[57] ABSTRACT

A cassette kitchen utensils set, comprising a variety of kitchen utensils, a handle bar, a locating seat and a cassette case; each kitchen utensil can be inserted into said handle bar for use and comprises a cutting plane to match with the cutting plane of a U-shaped holder on said locating seat so that it can be placed in said U-shaped holder and be retained thereinside by means of a nose of the respective U-shaped holder wherein the consolidated assembly of the variety of kitchen utensils, the handle bar and the locating seat is put in said cassette case to complete a compact, practicable and portable cassette kitchen utensils set.

1 Claim, 3 Drawing Sheets

CASSETTE KITCHEN UTENSILS SET

BACKGROUND OF THE INVENTION

The present invention relates to a cassette kitchen utensils set that comprises a variety of kitchen utensils, a handle bar, a locating seat and a cassette case. Each kitchen utensil can be inserted into said handle bar for application includes a cutting plane to match with the cutting plane in the handle bar and in a U-shaped holder mounted on the locating seat so that the utensil can be placed in said U-shaped holder and be retained thereinside by means of a nose on the respective U-shaped holder. The consolidated assembly of the variety of kitchen utensils, the handle bar and the locating seat is placed in said cassette case to provide a compact, practicable and portable cassette kitchen utensils set.

SUMMARY OF THE INVENTION

The present invention provides a cassette kitchen utensils set that is comprised of a handle bar, one set of kitchen utensils, a locating seat and a cassette case, wherein the locating seat comprises a locating plate extended from one end to form a space for the insertion of two handle bars, a plurality of U-shaped holders for respective alloction of said kitchen utensils set in a way that the cutting plane of each kitchen utensil matches the cutting plane of the respective U-shaped holder and each kitchen utensil is retained in the respective U-shaped holder by means of a nose; by means of the above arrangement the present cassette kitchen utensils set in a cassette case is provided.

BRIEF DESCRIPTION OF THE INVENTION

DESCRIPTION OF THE PREFERRED EMBODIMENTS

Figure 1:
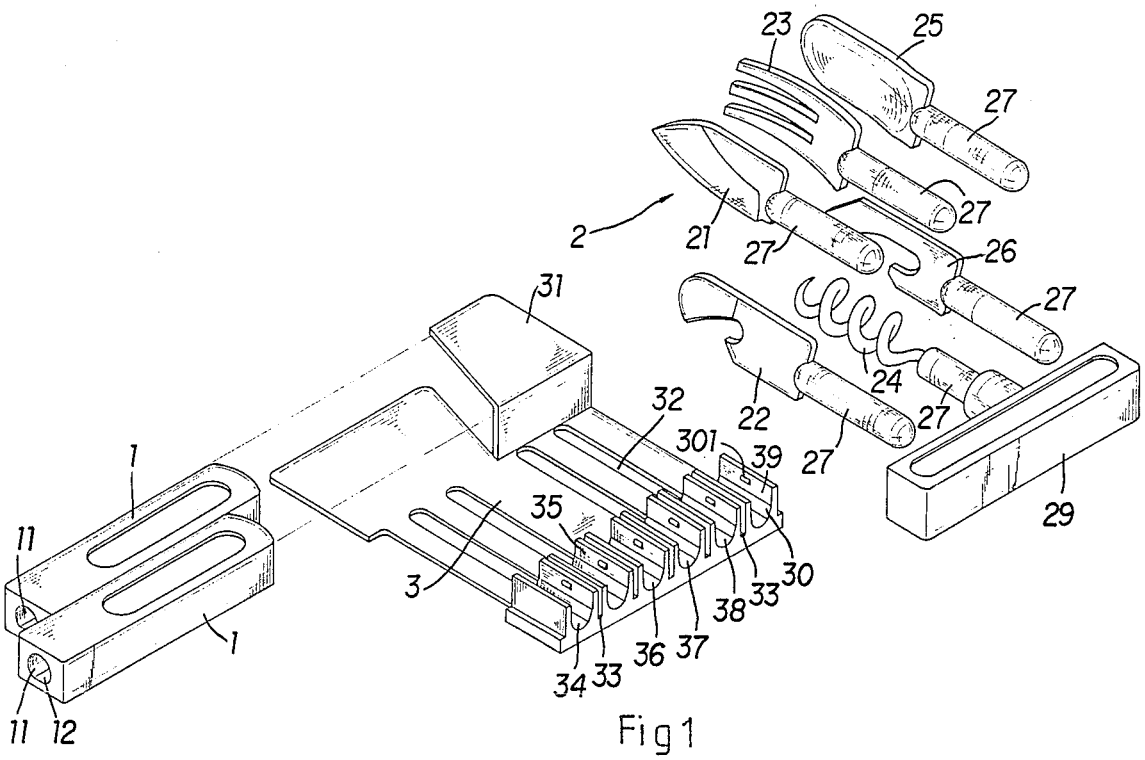
FIG. 1 is an exploded perspective view of a cassette kitchen utensils set embodying the present invention with the case removed.
Figure 2:
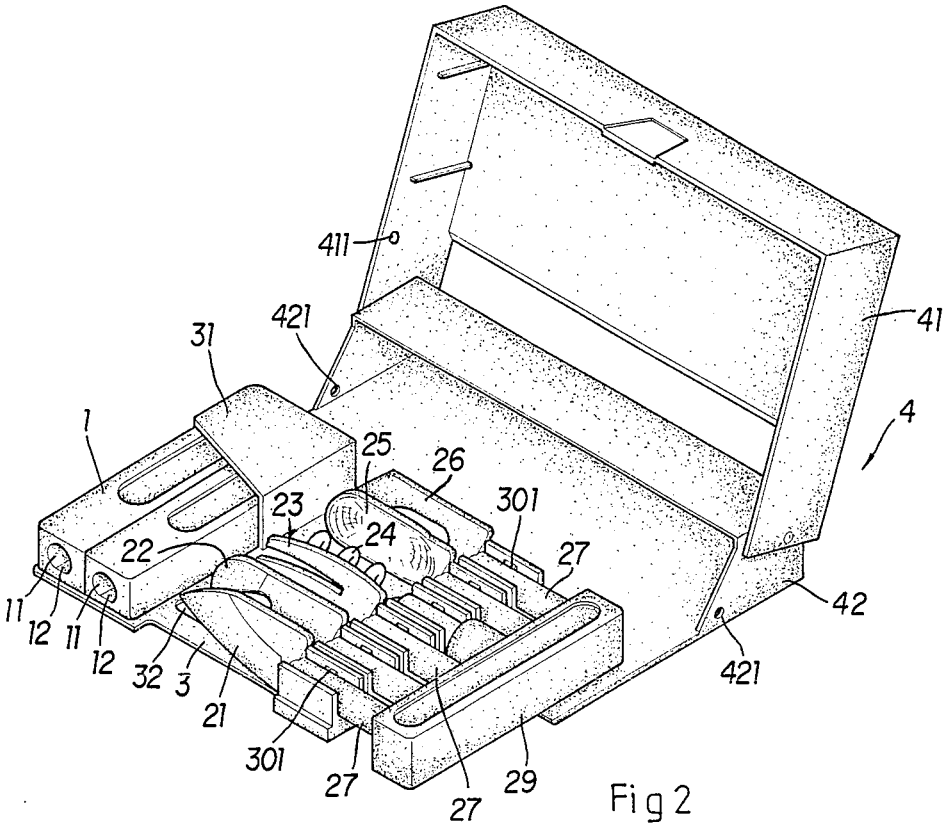
FIG. 2 is a perspective assembly view of the preferred embodiment.
Figure 3:
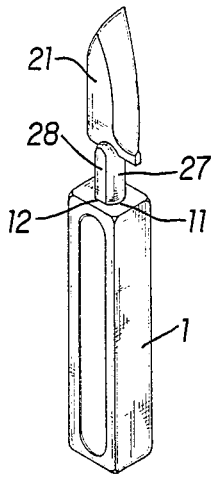
FIG. 3 is a perspective view of a handle-mounted utensil of this invention.

The present invention is, as shown in FIG. 1, FIG. 2 and FIG. 3, comprised of a plurality of handle bars 1, one set of kitchen utensils 2, a locating seat 3, and a cassette case 4. Said handle bar 1 comprises at the center a channel hole 11, said channel 11 has a cutting plane 12 at one side to match with the handle 27 and the cutting plane of the handle 28 (FIG. 3) of each kitchen utensil 2 (corkscrew excluded). Said kitchen utensils set is composed of a kitchen knife 21, a can opener 22, a table fork 23, a corkscrew 24, spoon 25, and bottle opener 26. The handle 27 of each kitchen knife 21, can opener 22, table fork 23, [corkscrew 24,]spoon 25 and bottle opener 26 comprises a cutting plane 28 to match both with the cutting plane 12 of the handle bar 1 and the cutting plane 30 of each U-shaped holder. Excepting the corkscrew 24, the cutting plane 28 of each kitchen utensils 2 can be reciprocally matched with the cutting plane 30 of any U-shaped holder either 34, 35, 36, 38 or 39. The handle 27 of said corkscrew 24 is attached to a grip 29 for rotating the corkscrew 24. Said locating seat 3 has a locating plate 31 extending at one end to form a place for the ends of two handle bars 1 between the locating plate 31 and the locating seat 3. The other end of the locating seat 3 has a plurality of U-shaped holders 34, 35, 36, 37, 38, 39 that are divided by a plurality of cutting gaps 33. Each U-shaped holder 34, 35, 36, 37, 38, 39 comprises a cutting plane 30 and a nose 301 for respective allocation of the kitchen utensils set. The locating seat 3 comprises a plurality of channels 32 to be respectively arranged against the U-shaped holders 34, 35, 36, 38, 39 for alternative placement of kitchen knife 21, can opener 22, table fork 23, spoon 25 or bottle opener 26. Because the corkscrew 24 comprises a fixed handle grip 29, it must be placed in the U-shaped holder 37 so as to match with the width of the locating seat. Said cassette case 4 is composed of an upper cover 41 and a lower cover 42 connected together by an axial joint with the nose 411 of the upper cover 41 retained in the round hole 421 of the lower cover 42 so as to contain the assembly of the locating seat 3, the kitchen utensils set 2 and the handle bars 1 thereinside.

For the assembly of the present invention, please said two handle bars 1 between the locating plate 31 and the locating seat 3; place the kitchen utensils 2 of kitchen knife 21, can opener 22, table fork 23, corkscrew 24, spoon 25, and bottle opener 26 in the respective U-shaped holders 34, 35, 36, 37, 38, 39, in good sequence, letting the cutting plane 28 of each kitchen utensil 2 matching with the cutting plane 30 of each U-shaped holder so that each kitchen utensil can be firmly retained in the respective U-shaped holder by means of the nose 301 of each respective U-shaped holder and well protected from breaking away. As arranged, the handle grip 29 of the corkscrew 24 is properly located at one side of the locating seat 3; and the handles 1, the kitchen utensils set 2 and the locating seat 3 are assembled as one consolidated unit. The consolidated unit thus assembled can then be put into he cassette case 4, letting the upper cover 41 and the lower cover 42 be firmly closed to complete a compact cassette kitchen utensils set for easy carriage.

While assembling, excepting that the corkscrew 24 must always be placed in the U-shaped holder 37, all the other kitchen utensils 2 can be placed in either one of the U-shaped holders.

While in application, insert the kitchen utensil to be used into the channel hole 11 of the handle bar 1, as shown in FIG. 3, by means of the cutting plane 12 of the channel hole 11 of the handle bar 1 to match with the cutting plane 28 of the handle 27 of the kitchen utensil.

The design and the structure of the handle bar 1, kitchen utensils set 2 and the locating seat provide the present invention be compact in size and practical in utility, which has been proved very excellent in practice.

I claim:

1. A cassette kitchen utensils set comprising:

a plurality of elongated handle bars, each having a longitudinal axial channel hole with a cutting plane along a portion of the circumference thereof;

a set of kitchen utensils including a knife, fork, spoon, bottle opener and can opener, each utensil having an integral handle defining a cutting plane therealong adapted to match the cutting plane in the bar when the utensil handle is inserted in the axial channel hole therein, said utensils further including a corkscrew having an integral handle and a handle bar grip mounted on the utensil handle at the center of said grip with said grip extending perpendicular to said utensil handle;

a flat locating seat, a plurality of mutually space U-shaped holders extending in a row along one edge, each U-shaped holder adapted to receive a utensil handle each holder except one defining a cutting plane to match the cutting plane on a utensil handle and each holder having an upper, resilient nose protruding internally therefrom for releasably retaining a handle therein said seat forming mutually spaced channels extending from each of said holers having a cutting plane adapted to receive the utensil end of the handle disposed in the respective holder, said holder not having a cutting plane being centrally located along said row and adapted to receive the corkscrew handle, said seat further defining on a side opposite said holders a substantially L-shaped locating plate for receiving end of said handle bars;

a cassette case having a lower cover and an upper cover hingedly interconnected at an edge thereof said cassette adapted to receive said seat, utensils and handle bars and closure means carried by said case for releasably securing said covers together.

* * * * *